US005776560A

United States Patent [19]

Kori et al.

[11] Patent Number: 5,776,560

[45] Date of Patent: Jul. 7, 1998

[54] UNITS FOR BUILDING ORNAMENTAL ARTICLE

[76] Inventors: Mituru Kori; Masako Kori, both of 12-16-804, Hong 4-chome, Bunkyo-ku, Tokyo, Japan

[21] Appl. No.: 269,931

[22] Filed: Jun. 30, 1994

[30] Foreign Application Priority Data

Jul. 2, 1993 [JP] Japan ..... 5-164802
Jun. 16, 1994 [JP] Japan ..... 6-134425

[51] Int. Cl.[6] ..... A47G 33/06

[52] U.S. Cl. ..... 428/20; 428/542.2; 434/82; 446/123

[58] Field of Search ..... 428/7, 20, 542.2, 428/542.8; 446/123; 434/82

[56] References Cited

U.S. PATENT DOCUMENTS 3,503,832 3/1970 Umminger, Jr. ..... 434/82 X
5,009,599 4/1991 Mueller ..... 446/123 X
5,152,530 10/1992 Dodek, II ..... 446/123 X
5,165,637 11/1992 Polley et al. ..... 428/7 X

FOREIGN PATENT DOCUMENTS 562623 6/1975 Switzerland ..... 446/123

*Primary Examiner*—Henry F. Epstein
*Attorney, Agent, or Firm*—Brinks Hofer Gilson & Lione

[57] ABSTRACT

A plurality of building members and a plurality of sheet members for connection thereof are provided. Each of the plurality of building members includes a main body portion and a coupling portion to be fitted on an end of the main body portion. One of the ends of the main body portion and the coupling portion is provided with a small diameter portion and the other of them is provided with a hole for receiving the small diameter portion. Each of the sheet members has a plurality of openings for passing the small diameter portion therethrough. The small diameter portion is passed through the opening of the sheet member and inserted into the hole to sandwich the coupling sheet member between the main body portion and the coupling portion to thereby fasten the building member comprised of the main body portion and the coupling portion to the coupling sheet member. In this way, a desired ornamental article can be created.

17 Claims, 5 Drawing Sheets

UNITS FOR BUILDING ORNAMENTAL ARTICLE

BACKGROUND OF THE INVENTION

1. Field of the Invention

This invention relates to units for constructing ornamental articles.

2. Prior Art

Ornamental trees are popular Christmas decorations. Although real trees are traditionally dressed with ornaments for Christmas decoration, there also exist artificial Christmas trees made of glass, in which the tree and ornamental parts are integrally formed and lighting equipment is provided internally. Although such Christmas trees are attractive, they are expensive to fabricate due to difficulties involved in glass forming.

SUMMARY OF THE INVENTION

In view of the above, the object of the present invention is to provide units for constructing ornamental articles, in which desired ornamental articles, for example, the above-mentioned glass Christmas trees, can be created from units which can be economically manufactured from a material such as glass.

Units for constructing ornamental articles of this invention are characterized in that they comprise a plurality of building members and a plurality of sheet members for connecting the plurality of building members, each of the plurality of building members including a main body portion and a coupling portion to be fitted on an end of the main body portion, one of the ends of the main body portion and the coupling portion being provided with a small diameter portion and the other of them being provided with a hole for receiving the small diameter portion, each of the sheet members having a plurality of openings for receiving the small diameter portion, the small diameter portion being passed through the opening of the sheet member and inserted into the hole to sandwich the sheet member between the main body portion and the coupling portion to thereby fasten the building member comprised of the main body portion and the coupling portion to the sheet member.

The coupling portion is longer than the end of the main body portion to be fitted on the coupling portion. Each of the building members is so arranged that, when an end of one of the main body portions is fitted on one end of the coupling portions an end of another main body portion is able to be fitted on the other end of the coupling portion.

The small diameter portion is preferably provided with a male thread and the hole is provided with a female thread into which the male thread is screwed.

In terms of appearance, it is preferable that the sheet member be formed of a transparent plastic sheet material, and the main body portion of the building member be formed of glass.

In the first embodiment of the present invention, the main body portion has small diameter portions provided at both ends thereof and the coupling portion is a tubular member having a hole passing therethrough.

In the second embodiment of the present invention, the main body portion has a bottle-like shape in which a recess portion is formed from a tip end of a small diameter portion formed on one end thereof to the inside of the main body portion. A coupling portion is provided with a hole having a partitioning wall provided mid-way down so as to separate the said hole into two portions. The coupling portion, therefore functions as a lid for the main body portion having a bottle-like shape, when the coupling portion is fitted on the main body portion.

In the third embodiment of the present invention, the main body portion has a small diameter portion provided at one end thereof and a hole at the other end thereof. The coupling portion has at one end thereof small diameter portion to be inserted into the hole of the main body portion and has provided at the other end thereof a hole into which the small diameter portion of another main body portion is inserted.

The fourth embodiment of the present invention comprises a plurality of building members each having threaded holes provided at both ends thereof, elongated coupling members each having a male thread to be screwed into the threaded hole of each of the building members, and a plurality of sheet members having a plurality of openings for passing the coupling members therethrough. A pair of building members are threadably engaged with the coupling member being passed through the opening of the sheet member from the opposite ends thereof to sandwich the sheet member between the ends of the pair of the building members facing each other to thereby fasten the building members to the sheet member.

In the fifth embodiment of the present invention, the building member has a small diameter portion provided at one end thereof and a hole capable of being fitted on the said small diameter portion at the other end thereof. Therefore, no coupling portion such as described above is required. The small diameter portion of the building member is passed through the opening of the sheet member and inserted into the hole of one of the other building members to sandwich the sheet member between the building members to thereby fasten the building members to the sheet member.

DETAILED DESCRIPTION OF THE INVENTION

Figure 1:
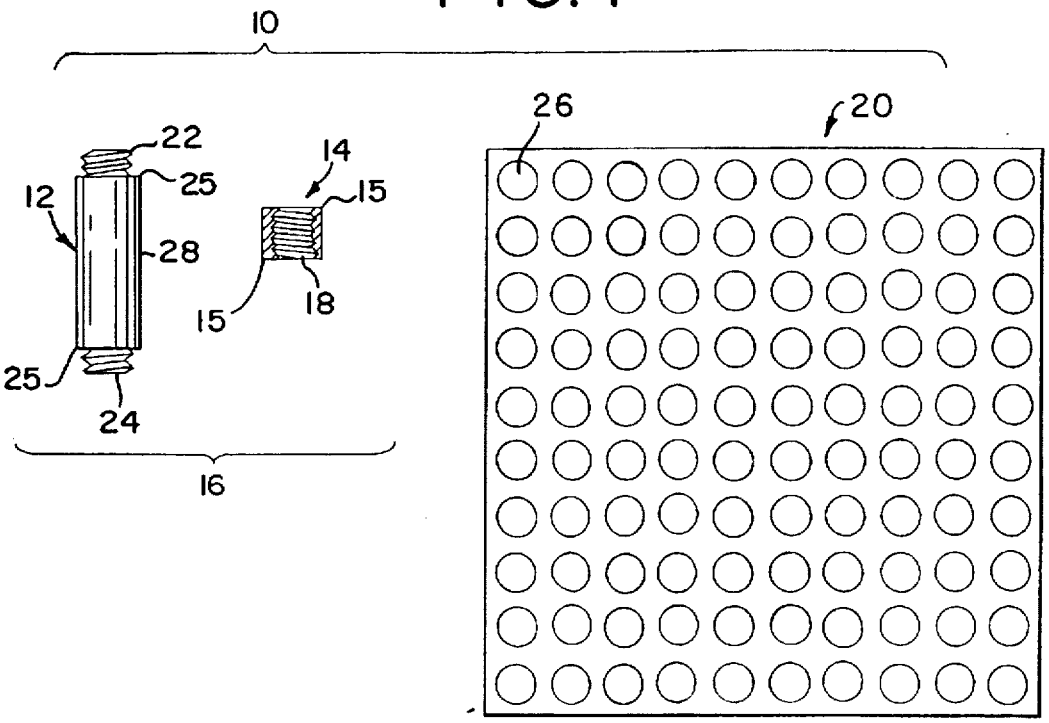
FIG. 1 shows components of a unit for constructing ornamental articles in accordance with the first embodiment of the invention.

FIG. 1 shows components of one of units (10) for constructing ornamental articles in accordance with the present invention. The unit (10) comprises a plurality of building members, each of which (16) consists of a main body portion (12) and a coupling portion (14) to be fitted on an end of the main body portion, and a plurality of sheet members (20) for connecting the building members.

The main body portion (12) of the building member (16) is generally cylindrical and has small diameter portions (22, 24) and shoulders (25) provided at both ends thereof. The circumferential surface of the small diameter portion is provided with a male thread. The coupling portion (14) is also generally cylindrical and has a through hole (18). Both ends of the coupling portion (14) constitute shoulders (15). The circumferential surface of the hole is provided with a female thread into which the male thread is screwed. From the point of view of appearance, it is preferable for the main body portion and the coupling portion to be formed of glass. Considering ease of manufacture, however, it is more practical that the main body portion be formed of glass and the coupling portion of a transparent plastic material.

The sheet member (20) has a plurality of openings (26). The diameter of each of the openings is slightly larger than the diameter of each of the small diameter portions (22, 24) and small than the diameter of the central large diameter portion (28) of the main body portion, and the diameter of the coupling portion. To assemble the units (10), the small diameter portion (22 or 24) of the main body portion (12) is passed through the opening (26) of the sheet member (20) and then threaded into the hole (18) of the coupling portion (14) so that the sheet member (20) will be sandwiched and captured by the shoulders (15 and 25) between the coupling portion (14) and the main body portion (12). The sheet member is preferably formed of a thin transparent plastic sheet material with a thickness of less than 1 mm, approximately 0.2 to 0.5 mm, for example.

Figure 2A:
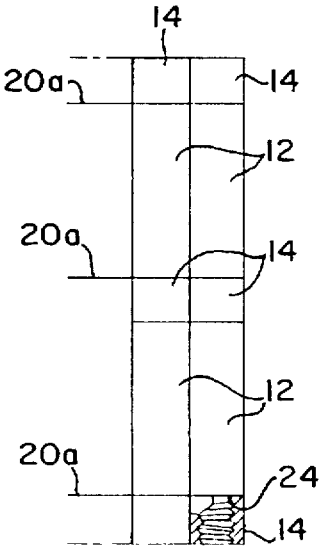
FIGS. 2A and 2B show a connection formation of the units of the first embodiment of the invention.
Figure 2B:
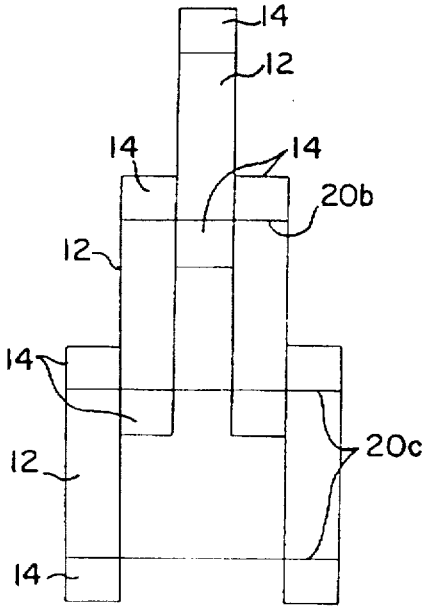

FIGS. 2A and 2B show connection formations of the building members (16) and the sheet members (20*a*, 20*b*). FIG. 2A shows a connection formation of two stages built by the building members, using three sheet members, four main body portions (12), and six coupling portions (14). The small diameter portion (24) with a male thread at the lower end of main body portion (12) of the building member in the lower stage is passed through the opening of the sheet member (20*a*) at the bottom. The small diameter portion (24) projecting downward from the sheet member is inserted into the coupling portion (14) at the bottom. The small diameter portion with a male thread provided at the upper end of the main body portion is inserted into the second coupling portion (14) without being passed through the opening of the sheet member. The main body portion of the building member in the upper stage is fitted on the second coupling portion (14) by being passed through the second sheet member. The small diameter portion at the upper end of the main body portion is projected upward through an opening of the top sheet member. The third coupling portion (14) is fitted on the small diameter portion. In the same way, a desired number of building members can be built up.

FIG. 2B shows another connection formation of the building members. In this formation, the building members are constructed to have a triangular formation.

Figure 4A:
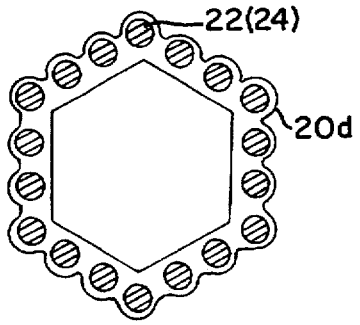
FIG. 4A is a transverse sectional view at IV—IV of FIG. 3.
Figure 4B:
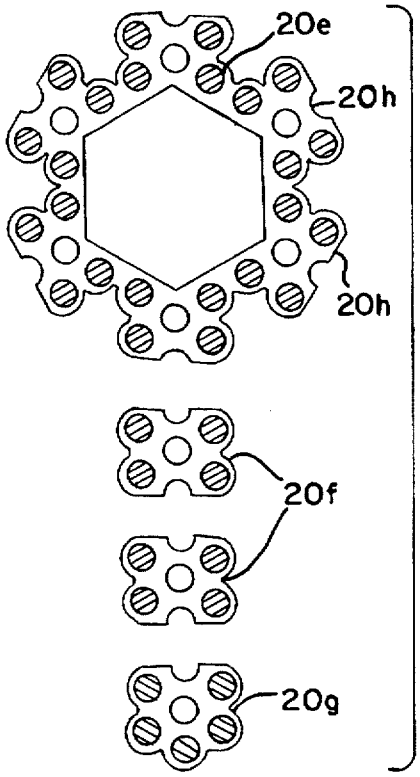
FIG. 4B is a plan view of a sheet member used in the Christmas tree shown in FIG. 3.
Figure 3:
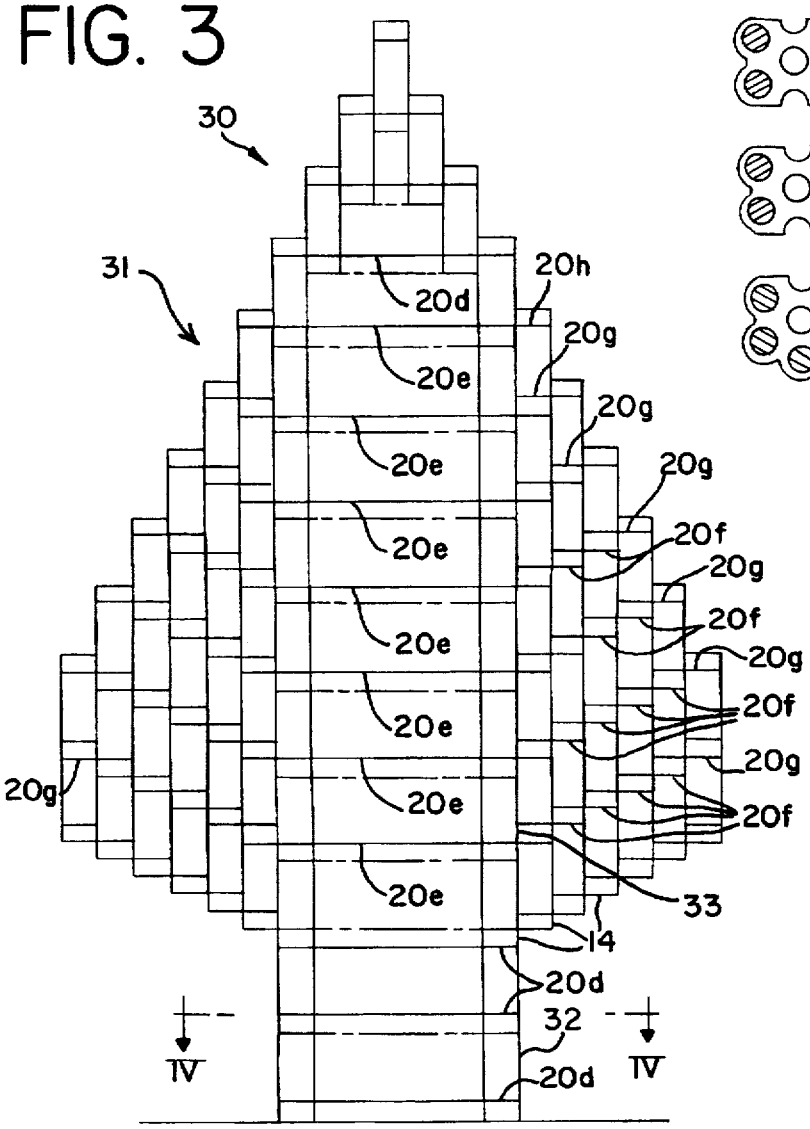
FIG. 3 is a sectional view showing a Christmas tree constructed from the units of the first embodiment.

FIGS. 3, 4A and 4B show an example of a Christmas tree (30) constructed from the building members. The lower first and second stages of the building members representing the trunk section (32) of the tree (30) are built in such a way as described above in connection with FIG. 2A. In this trunk section (32), three sheet members (20*d*) of a hexagonal shape (FIG. 4A) are used. Accordingly, the building members connected or built to form the part have a hexagonal cross section. FIG. 4B shows a sheet member (20*e*) used to construct the main stem (33) of the tree (30). As shown in FIG. 4B, the sheet member (20*e*) is formed generally in a hexagonal shape similar to the sheet member (20*d*) shown in FIG. 4A but with six additional tab portions (20*h*) at the corners of the hexagon. The sheet member (20*e*) makes the cross-section of the main stem (33) generally hexagonal. Also, each of the six tab portions (20*h*) provides a base for a branch-like section (31). Thus, the Christmas tree (30) has in total six branch-like sections (31) extending radially outward from the corners of the main stem(33). These branch-like sections are constituted in a way similar to that described in connection with FIG. 2B to spread outward in a radial direction, where a radially outside building member next to a radially inside building member is shifted upward relative to the inside building member by one coupling portion's length. Thus, referring to FIG. 3 as starting just above the trunk section (32), the branch-like sections increase in radial dimension in a stair-shaped manner by up to six building members, counted from the main stem (33) of the tree (30), and then decrease in radial dimension in the same manner. Finally, the main stem portion (33) also decreases in dimension so that the branch-like sections (31) converge at the top of the tree. More specifically, in FIG. 4B showing the sheet members (20*e*, 20*f* and 20*g*), the tab portions (20*h*) of the sheet member (20*e*) secure the innermost building members of the branch-like section (31) to the main stem (33). The sheet members (20*f*) are used for securing radially adjacent building members together in the branch-like section (31). The outermost building members are secured by virtue of the sheet member (20*g*). As shown in FIG. 4B, each of the branch-like sections (31) has a width corresponding to three rows of the openings. The openings in the internal middle row, however, are not used to fasten the building members.

The Christmas tree constructed as described above has an internal space where flashing lamps of various colors can be placed.

Figure 5A:
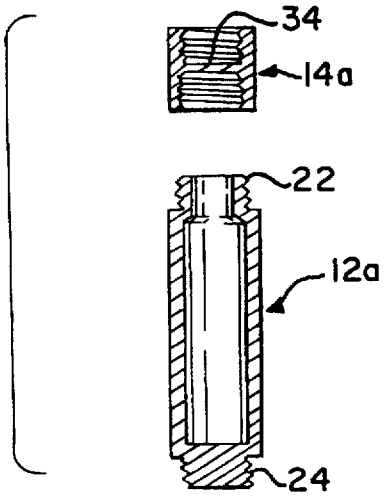
FIGS. 5A and 5B show a building member of the second embodiment of the invention.
Figure 5B:
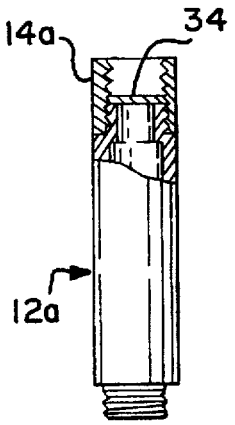

FIGS. 5A and 5B show a building member in accordance with the second embodiment of the invention. A main body portion (12*a*) of the building member is formed to have a bottle-like shape with the opening at the upper end. A coupling portion (14*a*) is provided with a partitioning wall (34) at the middle of a hole thereof to separate the hole into two portions and to close the opening at the upper end of the main body portion when the coupling portion is fitted on a small diameter portion (22) of the main body portion (12*a*). Due to such a design, the main body portion can be filled with colored water or the like to provide an enhanced ornamental effect.

Figure 6A:
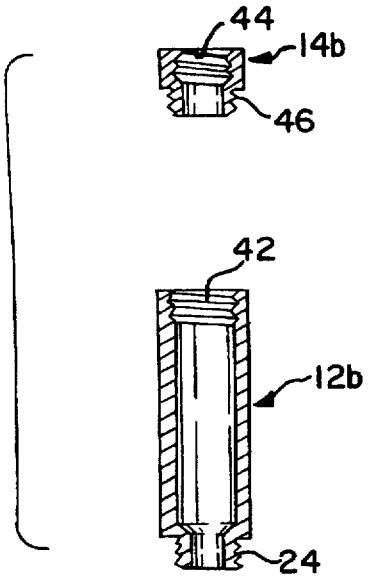
FIGS. 6A and 6B show a building member of the third embodiment of the invention.
Figure 6B:
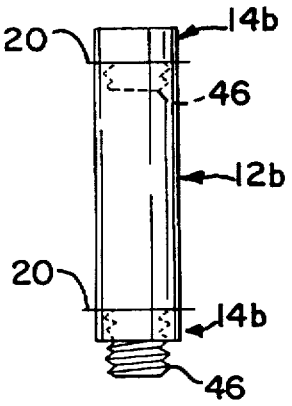

FIGS. 6A and 6B show a building member of the third embodiment of the invention. A main body portion (12*b*) of the building member is generally cylindrical and provided with a female thread (42) at the upper end. Correspondingly, a lower part of a coupling portion (14*b*) is provided with a small diameter portion (46) with a male thread to be engaged with the female thread (42) of the main body portion, while an upper half part thereof is provided with a female threaded hole (44) in the same manner as in the previous embodiments.

Figure 7A:
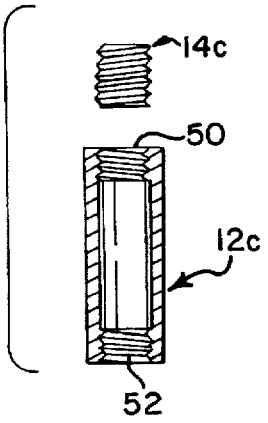
FIGS. 7A and 7B show a building member of the fourth embodiment of the invention.
Figure 7B:
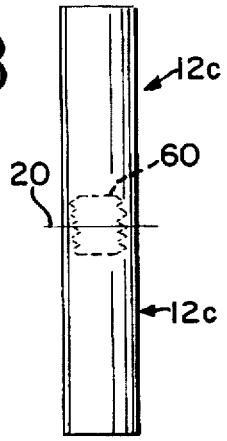

FIGS. 7A and 7B show a building member of the fourth embodiment of the invention. A main body portion (12*c*) of the building member is generally cylindrical and is provided with female threads (50, 52) at both ends. A coupling portion (14*c*) is provided with a male thread from the upper end to the lower end and a length of the coupling portion equals a sum of the lengths of the two female threaded holes (50, 52). In this building member, a sheet member is sandwiched between the end faces of the main body portions (12*c*) which are fitted on the coupling portion (14*c*) from the both ends thereof.

Figure 8A:
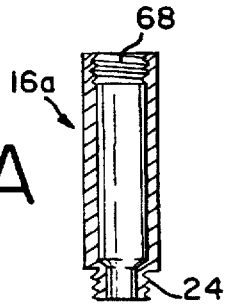
FIGS. 8A and 8B show a building member of the fifth embodiment of the invention.
Figure 8B:
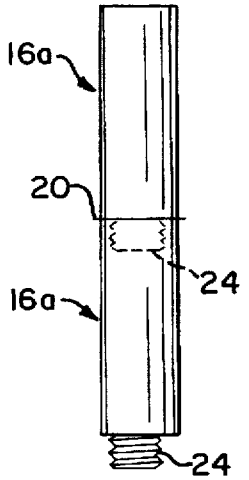

FIGS. 8A and 8B show a building member (16*a*) according to the fifth embodiment of the invention. This building member consists of one section which is equivalent to the main body portion (12*b*) of the building member shown in FIGS. 6A and 6B. The building member (16*a*) includes a female threaded hole (68) at the upper end and a male threaded small diameter portion (24) at the lower end so that the building members are fastened to the sheet member by passing the small diameter portion (24) of one building member through the hole (20) of the sheet member to threadably engage with the female threaded hole (68) of the other building member.

Figure 9A:
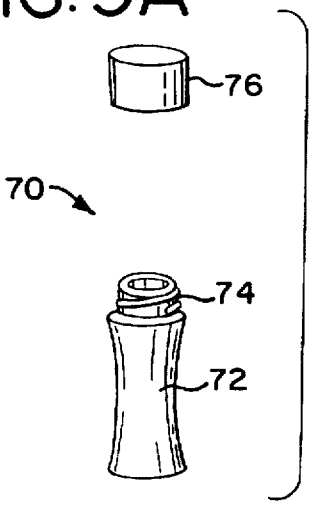
FIG. 9A shows a building member of the sixth embodiment of the invention.
Figure 9B:
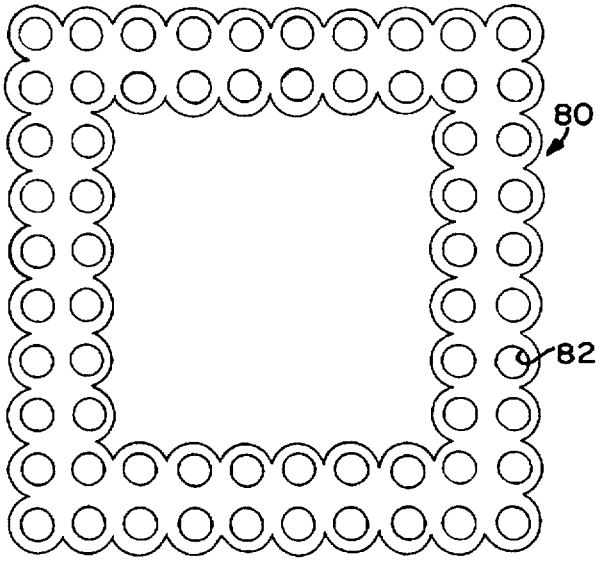
FIG. 9B shows a sheet member used in the sixth embodiment of the invention.
Figure 11:
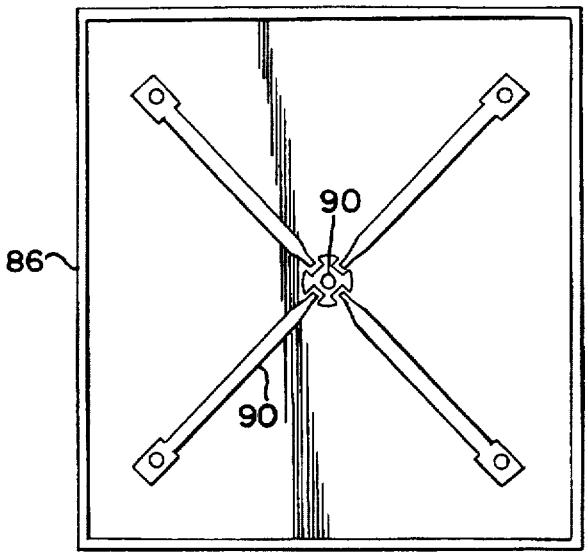
FIG. 11 is a plan view of the fastening means of the sixth embodiment of the invention.
Figure 10:
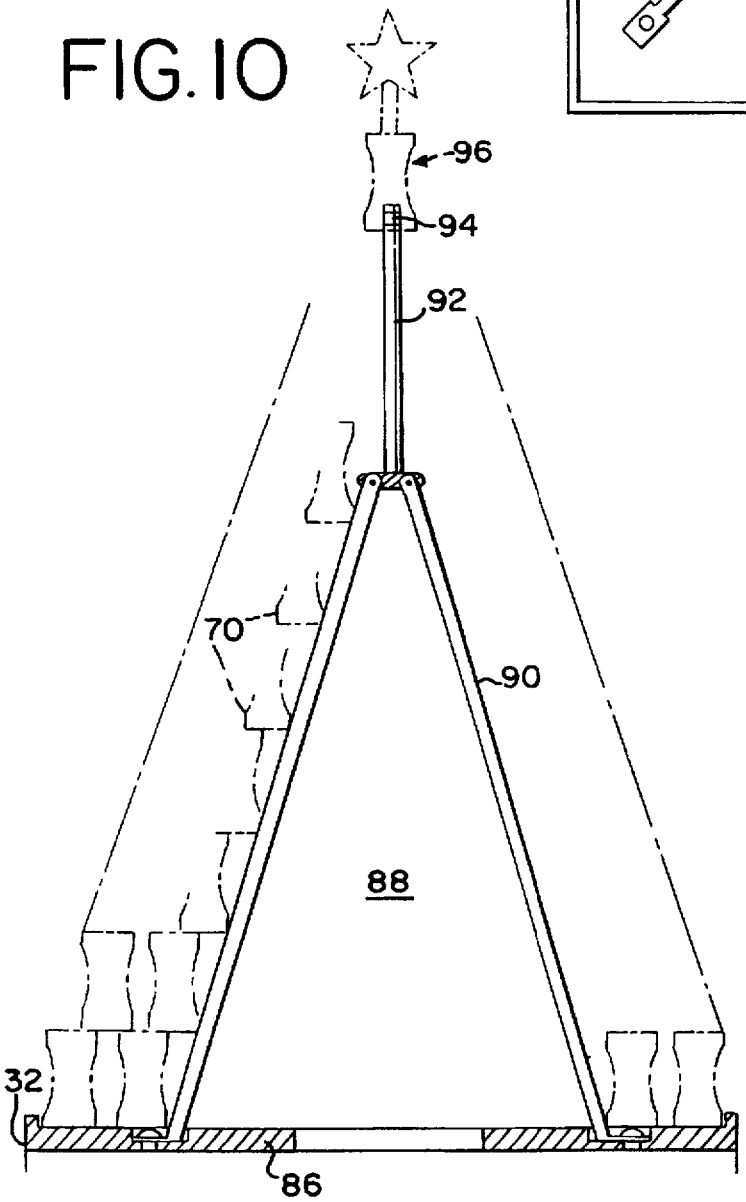
FIG. 10 is a side view showing fastening means for fastening the building members built in accordance with the sixth embodiment of the invention.

FIGS. 9 to 11 show the sixth specific embodiment of this invention. As shown in FIG. 9A, in this embodiment, a building member (70) consists of a main body portion (72) having a bottle-like shape and a coupling portion (76) in a lid-like shape for receiving the male threaded small diameter portion (74) of the main body portion. In the case of constructing an ornamental article using the building members, the male threaded small diameter portion (74) is passed through an opening (82) of a sheet member (80) as shown in FIG. 9B, and is fitted on the coupling portion (76) to form a stage consisting of the building member (70) and the sheet member (80). A desired ornamental article can be created by forming a plurality of such stages and fastening the built-up stages.

FIGS. 10 and 11 show a means for fastening the building member stages formed in a pyramid shape by using the building members (70) and the sheet members (80) as described above. In this example, the built-up building member stages are placed on a square base plate (86), and four legs are set up in an internal space (88) formed in the built-up stages in such a manner that the lower ends of the legs are fixed to the base plate and the upper ends of the legs converge at a point directly above the center of the plate. A central rod (92) is extended from the converged upper ends of the legs to an apex of the pyramid of the built-up stages. A building member (96) to be placed on the apex of the pyramid is fitted on a male threaded upper end (94) of the central rod, so that all of the building member stages are fastened between the said building member (96) and the base plate (86).

What is claimed is:

1. Units for constructing ornamental articles comprising:

a) a plurality of building members and a plurality of sheet members for connecting said plurality of building members;

b) each of said plurality of building members including a main body portion and a coupling portion to be fitted on an end of said main body portion, one of the ends of the main body portion and the coupling portion being provided with a small diameter portion and the other of them being provided with a hole for passing said small diameter portion therethrough;

c) each of said sheet members having a plurality of openings for receiving said small diameter portion; and d) said small diameter portion being passed through said opening of the sheet member and inserted into said hole to sandwich the sheet member between said main body portion and said coupling portion to thereby fasten the building member comprised of said main body portion and said coupling portion to the sheet member.

2. Units for constructing ornamental articles as set forth in claim 1, wherein said coupling portion is long enough for both of its ends to fit on the ends of two main body portions in order to connect those two main body portions.

3. Units for constructing ornamental articles as set forth in claim 1, wherein said small diameter portion is provided with a male thread and said hole is provided with a female thread with which said male thread is to be engaged.

4. Units for constructing ornamental articles as set forth in claim 1, wherein said sheet member is formed of transparent plastic sheet material, said main body portion of said building member is formed of glass and said coupling portion of the building member is formed of transparent plastic material.

5. Units for constructing ornamental articles as set forth in any one of claims 1 to 4, wherein said main body portion has a small diameter portion at both ends thereof and the coupling portion is tubular in shape and has a hole at both ends thereof.

6. Units for constructing ornamental articles as set forth in claim 5, wherein said main body portion has a space inside which communicates with the outside through an opening formed at a tip of one of said small diameter portions, and said coupling portion is provided with a partitioning wall which separates said holes formed at both its ends.

7. Units for constructing ornamental articles as set forth in any one of claims 1 to 4, wherein said main body portion has said small diameter portion at one end thereof and has said hole at the other end thereof, and said coupling portion has at one end thereof said small diameter portion to be inserted into said hole of said main body portion and has at the other end thereof said hole into which the small diameter portion of the main body portion is to be inserted.

8. Units for constructing ornamental articles comprising:

a) a plurality of building members each having a main body portion with threaded holes formed at both ends thereof and a coupling portion having male threads formed therearound to be screwed into a threaded hole of the building member; and b) a plurality of sheet members having a plurality of openings for said coupling portions to pass through, c) said building members being connected with said coupling portions extending through the openings of said sheet members to sandwich said sheet members between said main body portions.

9. Units for constructing ornamental articles comprising:

a) a plurality of building members and a plurality of sheet members for connecting said building members;

b) said building member having a small diameter portion at one end thereof and a hole capable of receiving said small diameter portion of another building member at the other end thereof; and c) said sheet member having a plurality of openings for receiving said small diameter portion, d) said smaller diameter portion of one building member being passed through the opening of said sheet member and inserted into said hole of another building member to sandwich said sheet member between said two building members to thereby fasten said building members to said sheet member.

10. An ornamental article comprising tiers of assembled building members and sheet members;

a) each sheet member having a plurality of openings with spacing therebetween;

b) each building member composed of a main body portion and a coupling portion for connecting said main body portion to the main body portion of another building member in order to connect said building members in a series;

c) said main body portion and said coupling portion having a small diameter portion and a hole for receiving said small diameter portion to connect said main body portion and said coupling portion;

d) said sheet members being spaced apart by at least one coupling portion or one main body portion and sandwiched between said main body portion and said coupling portion in such a manner that said small diameter portion passes through the opening of said sheet member into said hole; and e) a plurality of series of said connected building members being laterally spaced from one another by the spacing between the openings in said sheet members.

11. The ornamental article as recited in claim 10, wherein said main body portion and said coupling portion comprise two separate members each having two ends.

12. The ornamental article as recited in claim 11, wherein said main body portion has small diameter portions at both its ends, and said coupling portion has holes at both its ends.

13. The ornamental article as recited in claim 11, wherein said main body portion has the small diameter portion at one end and the hole at the other end, and said coupling portion has the small diameter portion at one end and the hole at the other end.

14. The ornamental article as recited in claim 11, wherein said main body portion has holes at both its ends, and said coupling portion has small diameter portions at both its ends.

15. The ornamental article as recited in claim 14, wherein said coupling portion is defined only by said small diameter portion, and said sheet is sandwiched by two adjacent main body portions.

16. The ornamental article as recited in claim 10, wherein said main body portion and said coupling portion of a building member are formed in one member having two ends, and said building member has the small diameter portion at one end and the hole at the other end for receiving the small diameter portion of another building member.

17. An ornamental article comprising tiers of assembled building members and sheet members;

a) each sheet member having a plurality of openings with spacing therebetween;

b) each building member comprising a main body portion, small diameter portion, a shoulder and a coupling portion;

c) said sheet members being spaced apart from one another by at least one coupling portion or one main body portion of a plurality of building members, and said shoulder and said coupling portion sandwiching said sheet member; and d) the main body portions of said plurality of building members being laterally spaced from one another due to the spacings between the openings in said sheet members.

* * * * *

UNITED STATES PATENT AND TRADEMARK OFFICE

CERTIFICATE OF CORRECTION

PATENT NO. : 5,776,560

DATED : July 7, 1998

INVENTOR(S) : Mituru Kori et al.

It is certified that error appears in the above-identified patent and that said Letters Patent is hereby corrected as shown below:

In claim 8, line 8, please change "," (comma) to --;-- (semicolon).

In claim 9, line 4, please change "small" to --smaller--.

In claim 9, line 6, please change "small" to --smaller--.

In claim 9, line 9, please change "small" to --smaller-- and "," (comma) to --;-- (semicolon).

Signed and Sealed this

Third Day of October, 2000

*Attest:*

Q. TODD DICKINSON

*Attesting Officer*

*Director of Patents and Trademarks*